US005328723A

United States Patent [19]

Horiki et al.

[11] Patent Number: 5,328,723

[45] Date of Patent: * Jul. 12, 1994

[54] MASKING MEMBER

[75] Inventors: Seinosuke Horiki; Reiji Makino; Kuninori Ito, all of Nagoya, Japan

[73] Assignee: Nagoya Oilchemical Co., Ltd., Aichi, Japan

[ * ] Notice: The portion of the term of this patent subsequent to Apr. 3, 2007 has been disclaimed.

[21] Appl. No.: 785,914

[22] Filed: Nov. 4, 1991

Related U.S. Application Data

[63] Continuation of Ser. No. 418,264, Oct. 6, 1989, abandoned, which is a continuation-in-part of Ser. No. 101,689, Sep. 28, 1987, abandoned.

[30] Foreign Application Priority Data

| | | | |
|---|---|---|---|
| Sep. 30, 1986 | [JP] | Japan | 61-149582 |
| Sep. 30, 1986 | [JP] | Japan | 61-149584 |
| Sep. 30, 1986 | [JP] | Japan | 61-149587 |
| Mar. 27, 1987 | [JP] | Japan | 62-046075 |
| Apr. 15, 1987 | [JP] | Japan | 62-056988 |

[51] Int. Cl.[5] ..... B05D 1/32

[52] U.S. Cl. ..... 427/272; 427/282; 427/300; 118/504

[58] Field of Search ..... 427/282, 300, 272; 118/504, 505

[56] References Cited

U.S. PATENT DOCUMENTS

| | | | |
|---|---|---|---|
| 3,128,029 | 4/1964 | Price et al. | 229/1.5 B |
| 4,420,081 | 12/1983 | Dart | 229/1.5 B |
| 4,528,221 | 7/1985 | Komatsuzaki et al. | 428/36.5 |
| 4,649,068 | 3/1987 | Collette | 428/542.8 |
| 4,714,633 | 12/1987 | Horiki et al. | 428/317.3 |
| 4,822,650 | 4/1989 | Horiki et al. | 428/34.2 |
| 4,879,158 | 11/1989 | Horiki et al. | 428/159 |
| 4,913,786 | 4/1990 | Horiki et al. | 427/264 |

FOREIGN PATENT DOCUMENTS

| | | | |
|---|---|---|---|
| 2738375 | 3/1979 | Fed. Rep. of Germany | 229/1.5 B |

*Primary Examiner*—George F. Lesmes
*Assistant Examiner*—Christopher Brown
*Attorney, Agent, or Firm*—Cooper & Dunham

[57] ABSTRACT

A masking member consisting of a vessel form inserting part made up of a bottom and a truncated conical wall portion, said wall portion extending upwardly from the perimeter of said bottom, and an outwardly extending flange formed around the wall portion of said inserting part, said masking member be made of a thermoplastic foam is presented in this invention. When said masking member is used, said inserting part of said masking member is inserted into a hole of an article and said flange of said masking member covers the surroundings of said hole. Thus the inside of said hole and said surroundings of said hole are protected from a surface treatment and the removing of said masking member after said surface treatment from said hole may be very smooth without obstruction of the film of said surface treatment.

1 Claim, 11 Drawing Sheets

MASKING MEMBER

This is a continuation of application Ser. No. 418,264, filed Oct. 6, 1989, now abandoned, which is a continuation-in-part of application Ser. No. 105,689 filed Sep. 28, 1987, now abandoned.

BACKGROUND OF THE INVENTION

The present invention relates to a masking member used to protect the inside and circumference of a hole such as a water outlet hole, a cable piercing hole and the like from a surface treatment such as coating, plating, phosphatizing, vacuum evaporation and the like. More particularly, the present invention relates to a new masking member consisting of a vessel form inserting part made up of a bottom and a truncated conical wall portion, said wall portion extending upwardly from the perimeter of said bottom, and an outwardly extending flange formed around the wall portion of said inserting part, said masking member be made of a thermoplastic foam. In a case where a surface treatment is effected on the surface of an article, said surface of said article often has hole(s) whose inside must be protected from said surface treatment. Said hole(s) may be a water outlet hole, a cable piercing hole and the like, and a grummet, a plug, a bolt and the like may be inserted into said hole(s).

DESCRIPTION OF THE PRIOR ART

Hitherto, a masking member of the plug type has been used to protect said hole from a surface treatment. Said masking member may be inserted into a hole of an article to be protected before said surface treatment and, when said surface treatment is effected on the surface of an article, said hole of said masking member is not subjected to said surface treatment. After said surface treatment, said masking member may be removed from said hole of said article. Nevertheless, the resulting film of said surface treatment covers continuously the surface of said article and the surface of said masking member enough to obstruct the smooth removing of said masking member from said hole of said article. Further, in a case where said surface treatment is a coating and said masking member has a taper form, said coating may collect on the surroundings of said hole, namely on the surroundings of said masking member to form a thick part of said coating film on said surroundings of said hole. Said thick part may obstruct a grummet, plug, bolt and the like from fitting tightly to said hole.

SUMMARY OF THE INVENTION

Accordingly, an object of the present invention is to save trouble when the masking member is removed from said hole(s) of an article, the inside of which is necessary to be protected from a surface treatment.

Further, the object of the present invention is to provide a tight fitting for a grummet, plug, bolt and the like to said hole(s) of an article. According to the present invention, there is provided a masking member consisting of a vessel form inserting part made up of a bottom and a truncated conical wall portion, said wall portion extending upwardly from the perimeter of said bottom, and an outwardly extending flange formed around the wall portion of said inserting part, said masking member be made of a thermoplastic foam. When said masking member is used, said masking member is inserted into said hole of said article, the inside of which is necessary to be protected from a surface treatment, and said flange of said masking member covers the surroundings of said hole and, as a result, the inside and the surroundings of said hole(s) is protected from a surface treatment.

Said masking member may be easily removed from the hole of an article and a grummet, plug, bolt and the like may fit tightly to the hole of the article without looseness.

Said masking member may be made of a thermoplastic foam such as polystyrene foam, polyethylene foam, polypropylene foam and the like and is advantageously manufactured by the vacuum forming of said thermoplastic foam sheet, and further said masking member may be colored by (a) suitable color(s) if desired, for the purpose of selection of the specified masking member according to the hole into which it is to be inserted. A masking member made of polystyrene foam may be one of the most suitable masking member in the present invention.

DETAILED DESCRIPTION

FIG. 1 to FIG. 4 relate to the first embodiment of the present invention. Referring now to, said figures, a masking member(110) consists of an inserting part(111) having a vessel form consisting of a circular bottom(111A) and a perpendicular wall(111B) which extends upwards from the circumference of said bottom(111A), and a flange(112) which is extended from the upper edge of said wall(111B). Said inserting part(111) has a taper form decreasing in diameter from the base of said inserting part(111) to the top of said inserting part(111).

Said masking member(110) is advantageously manufactured by the vacuum forming of a thermoplastic foam sheet such as polystyrene foam sheet, polyethylene foam sheet, polypropylene foam sheet and the like. Desirably, the thickness of said thermoplastic foam sheet is in the range of 0.5 to 5 mm and the expansion ratio of said thermoplastic is in the range of 2 to 20 for easiness of the vacuum forming and the strength of the resulting masking member. Of course, said masking member(110) may be manufactured by the expansion molding of the thermoplastic expandable beads.

Figure 1:
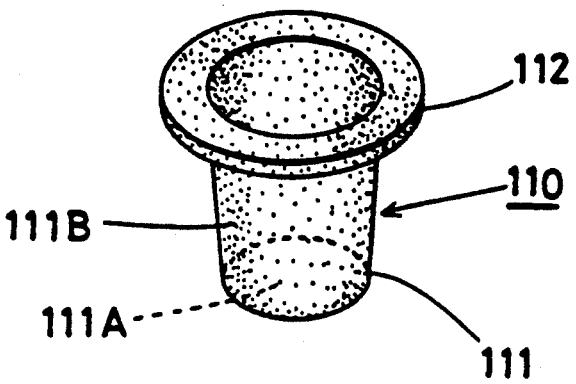
FIG. 1 is a perspective view of the first embodiment of the present invention.
Figure 2:
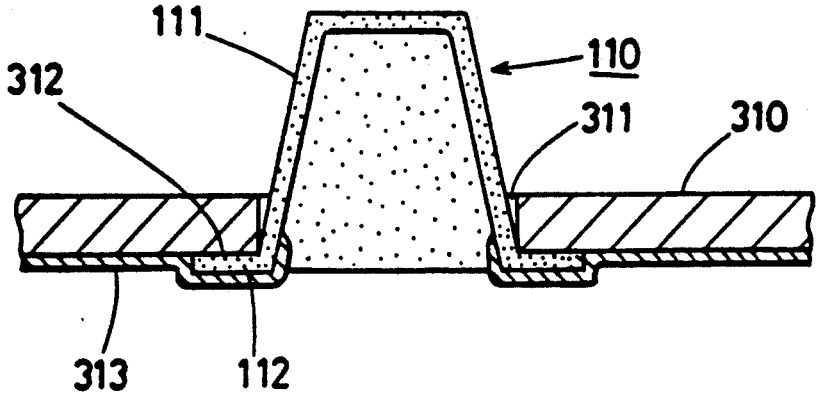
FIG. 2 is a partial side sectional view of the first embodiment of the present invention.

When said masking member(110) is used, said masking member (110) protects the inside of a hole(311) of an article(310) by inserting said inserting part(111) into said hole(311) as shown in FIG. 2, and said flange(112) of said masking member(110) covers the surroundings(312) of said hole (311). After which, a surface treatment such as a coating is effected on the surface of said article(310) to form a film(313) of said surface treatment and the inside and surroundings of said hole(311) are not subjected to said surface treatment. After said surface treatment, said masking member may be removed from said hole(311) by hand, hook and the like. Said masking member(110) can be also removed from said hole(311) by heating at a temperature higher than the softening point of said thermoplastic foam. When said masking member(110) is heated to a temperature higher than the softening point of the thermoplastic foam of said masking member, it may be softened and gases such as air, gas of a blowing agent and the like in the cells of said thermoplastic foam may first expand and so said masking member may also expand and, then, when said gases leave the cells, said masking member(110) may shrink rapidly and remove itself naturally from said hole(311). In case that the expansion ratio of the thermoplastic foam as the material of said masking member is in the range of 2 to 20, said masking member is easily removed by employing hook since hook stick easily into said masking member. Of course, easiness of removing of the masking member is very important especially for the continuous mass-production system wherein the robot is employed for attaching and removing of the masking member.

Figure 3:
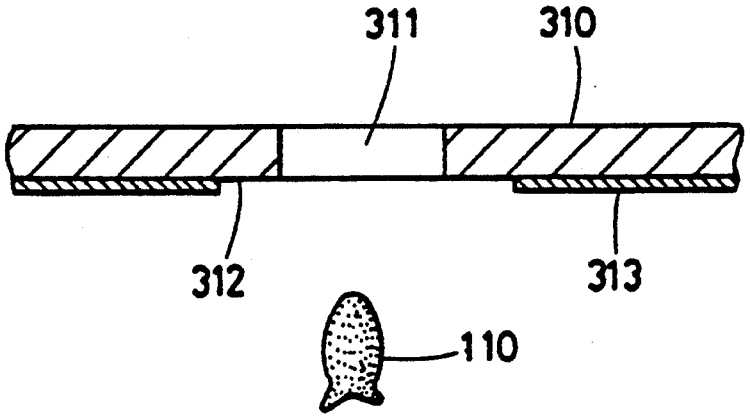
FIG. 3 is a partial side sectional view of the first embodiment of the present invention.
Figure 4:
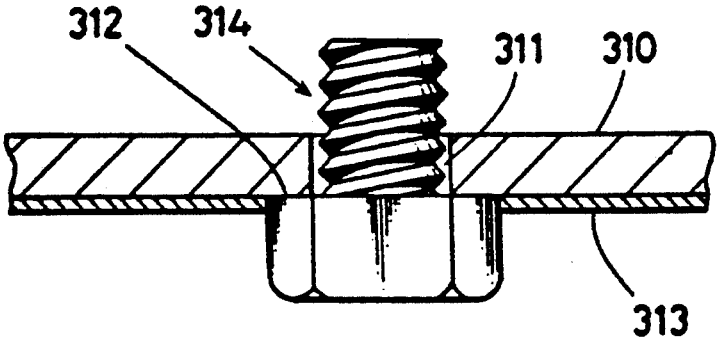
FIG. 4 is a partial side sectional view of the article including the hole into which a bolt has been inserted.

After said masking member(110) is removed from said hole (311), said film(313) has not been formed inside and on said surrounding(312) of said hole(311) as shown in FIG. 3 and a bolt(314) may be tightly inserted into said hole(311) as shown in FIG. 4, since there is no thick part of said film (313) of said surface treatment on said surroundings(312) of said hole(311). Further, said masking member(110) can be used for many holes having different diameters since said inserting part(111) of said masking member(110) has a taper form as before mentioned.

Figure 5:
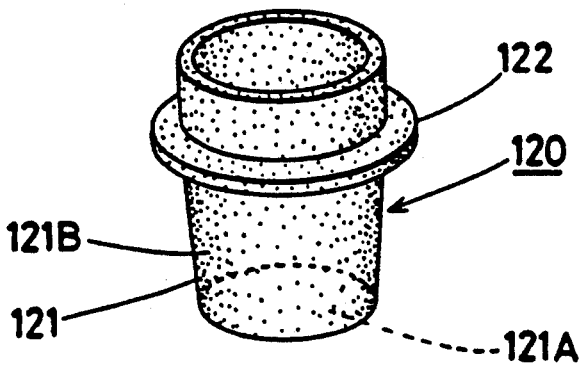
FIG. 5 is a perspective view of the second embodiment of the present invention.
Figure 6:
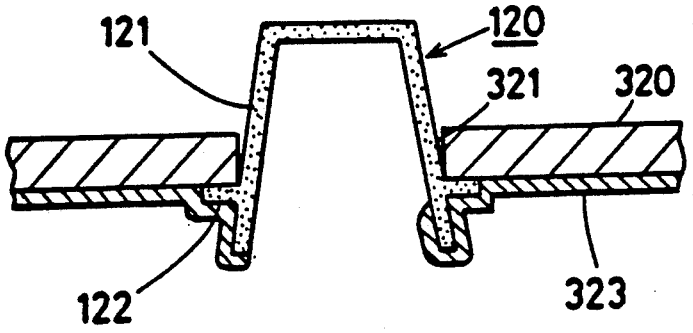
FIG. 6 is a partial side sectional view of the second embodiment of the present invention.

FIG. 5 and FIG. 6 relate to the second embodiment of the present invention. In this embodiment, a masking member(120) consists of an inserting part(121) having a vessel form consisting of a circular bottom(121A) and a perpendicular wall(121B) which extends upwards from the circumference of said bottom(121A) and a flange(122) which is extended from the upper part of said wall(121B). Said inserting part(121) has a taper form decreasing in diameter from the base of said inserting part(121) to the top of said inserting part(121).

Said masking member(120) may be manufactured by the vacuum forming of a thermoplastic foam sheet, the expansion molding of a thermoplastic expandable beads and the like, and when said masking member(120) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20.

Said masking member(120) of this embodiment is used as same as the first embodiment and film(323) of the surface treatment such as coating may be cut by the upper edge of said inserting part(121) as shown in FIG. 6, and therefore, said masking member(120) may be smoothly removed from the hole(321) of the article(320) without the obstruction of said film(323).

Figure 7:
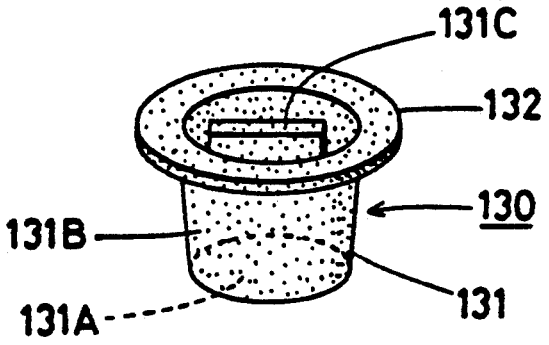
FIG. 7 is a perspective view of the third embodiment of the present invention.
Figure 8:
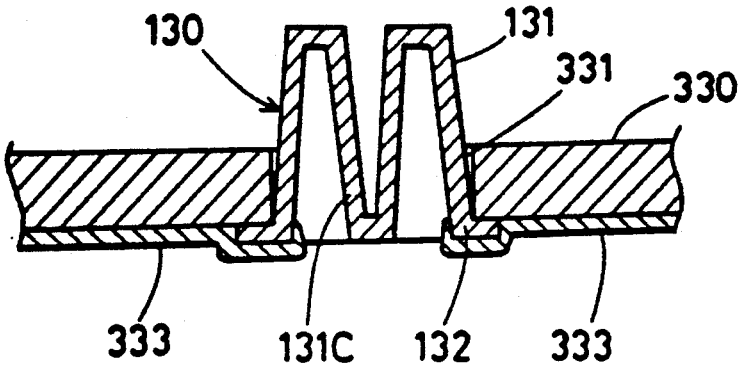
FIG. 8 is a partial side sectional view of the third embodiment of the present invention.

FIG. 7 and FIG. 8 relate to the third embodiment of the present invention. In this embodiment, a masking member (130) comprises an inserting part(131) having a vessel form consisting of a circular bottom(131A) from which a grip (131C) is risen and a perpendicular wall(131B) which extends upwards from the circumference of said bottom(131A), a flange(132) which is extended from the upper edge of said wall(131B). Said inserting part(131) has a taper form decreasing in diameter from the base of said inserting part (131) to the top of said inserting part(131).

Said masking member(130) may be manufactured by the vacuum forming of a thermoplastic foam sheet, the expansion molding of a thermoplastic expandable beads and the like, and when said masking member(130) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20. The masking member(130) of this embodiment is easily handled by holding said grip(131C) when said masking member(130) is inserted into the hole(331) of the article(330) or removed from the hole(331).

Figure 9:
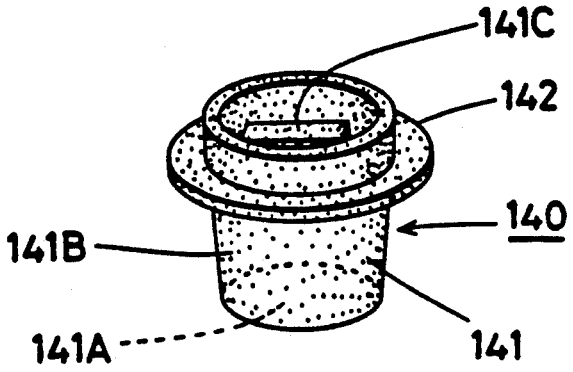
FIG. 9 is a perspective view of the fourth embodiment of the present invention.
Figure 10:
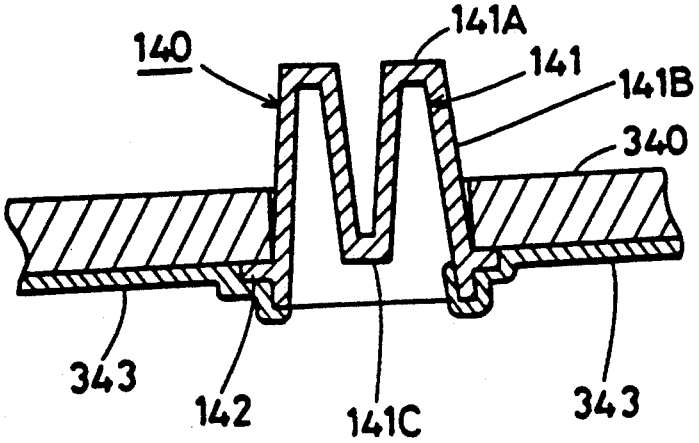
FIG. 10 is a partial side sectional view of the fourth embodiment of the present invention.

FIG. 9 and FIG. 10 relate to the fourth embodiment of the present invention. In this embodiment, a masking member (140) consists of a inserting part(1 41) having a vessel form consisting of a circular bottom(141A) from which a grip (141C) is risen and a perpendicular wall (141B) which extends upwards from the circumference of said bottom(141) and a flange(142) which is extended from the upper part of said wall(141B). Said inserting part(141) has a taper form decreasing in diameter from the base of said inserting part (111) to the top of said inserting part(111).

Said masking member(140) may be manufactured by the vacuum forming of a thermoplastic foam sheet, the expansion molding of a thermoplastic expandable beads and the like, and when said masking member(140) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20.

Said masking member(140) of this embodiment is easily handled by holding said grip(141C) when the masking member (140) is inserted into the hole(341) of the article(340) or removed from the hole(341) as same as the third embodiment of the present invention. Further, the film(343) of the surface treatment such as coating may be cut by the upper edge of said inserting part(141) as same as the second embodiment as shown in FIG. 10 so that said masking member (140) is easily removed from the hole(341) without the obstruction of said film(343).

Figure 11:
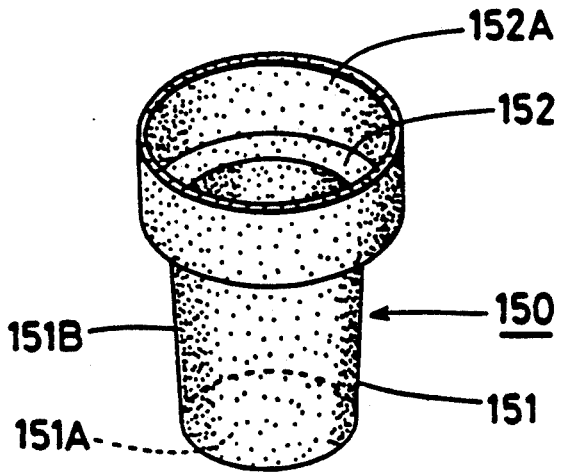
FIG. 11 is a perspective view of the fifth embodiment of the present invention.
Figure 12:
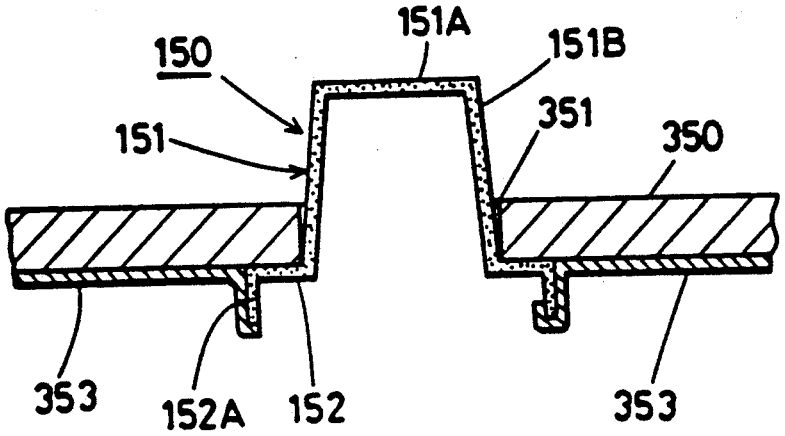
FIG. 12 is a partial side sectional view of the fifth embodiment of the present invention.

FIG. 11 and FIG. 12 relate to the fifth embodiment of the present invention. In this embodiment, a masking member (150) consists of an inserting part(151) having a vessel form consisting of a circular bottom(151A) and a perpendicular wall(151B) which extends upwards from the circumference of said bottom(151A), and a flange(152) which is extended from the upper edge of said wall(151B), and has a perpendicular wall(152A) which extends upwards from the circumference of said flange(152). Said inserting part(111) has a taper form decreasing in diameter from the base of said inserting part (111) to the top of said inserting part(111).

Said masking member(150) may be manufactured by the vacuum forming of a thermoplastic foam sheet, the expansion molding of a thermoplastic expandable beads and the like, and when said masking member(150) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20.

Said masking member(150) of this embodiment is used as same as the first, second, third and fourth embodiment, and in this embodiment the film(353) of the surface treatment such as coating may be cut by the edge of said perpendicular wall (151A) as shown in FIG. 12, so that said masking member (150) is easily removed from the hole(351) of the article (350) without obstruction of said film(353).

Figure 13:
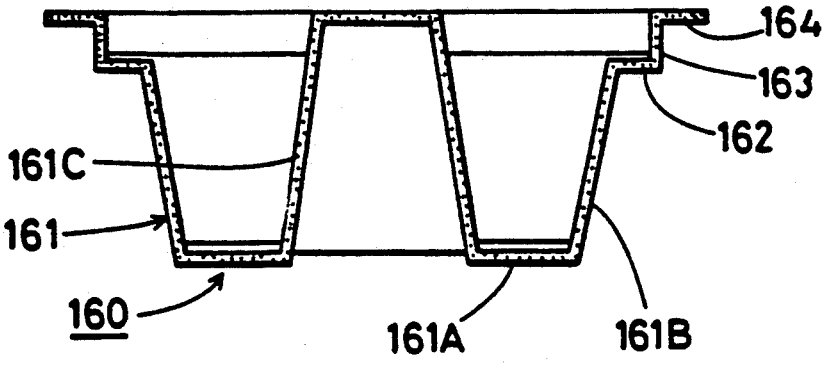
FIG. 13 is a side sectional view of the sixth embodiment of the present invention.
Figure 14:
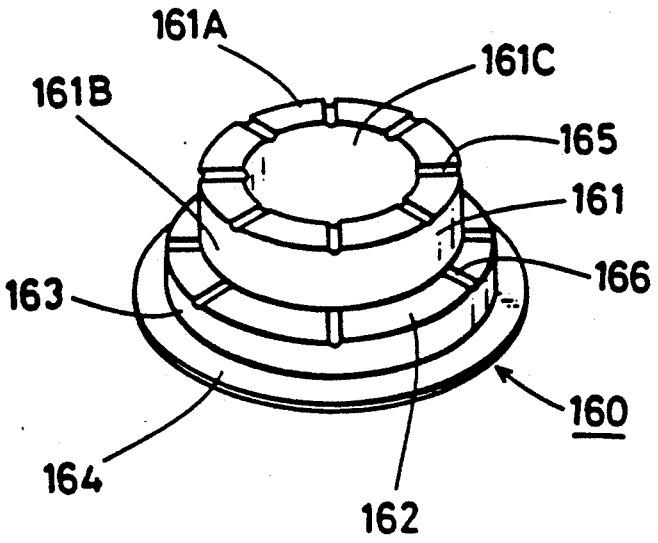
FIG. 14 is a perspective view of the sixth embodiment of the present invention.

FIG. 13 and FIG. 14 relate to the sixth embodiment of the present invention. In this embodiment, a masking member (160) consists of an inserting part(161) having a vessel form consisting of a circular bottom(161A) from which a grip(161C) is risen and a perpendicular wall(161B) which extends upwards from the circumference of said bottom(161A), a lower flange(162) which is extended from the upper edge of said perpendicular wall(161B), a perpendicular wall(163) which extends upwards from the circumference of said lower flange(162), and an upper flange(164) which is extended from the upper edge of said perpendicular wall(163). Plural ribs(165) and (166) are respectively formed on said bottom(161A) of said inserting part(161) and said lower flange(162) to reinforce themselves. Said inserting part (161) has a taper form decreasing in diameter from the base of said inserting part(161) to the top of said inserting part(161).

Said masking member(160) may be manufactured by the vacuum forming of a thermoplastic foam sheet, the expansion molding of a thermoplastic expandable beads and the like, and when said masking member(160) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20.

Said masking member(160) of this embodiment is easily handled by holding said grip(161C) when said masking member (160) is inserted into the hole of the article or removed from the hole as same as the third and the fourth embodiments and the film of the surface treatment may be more completely cut by said upper flange(164) so that said masking member (160) is more easily removed from the hole without the obstruction of the film.

Figure 15:
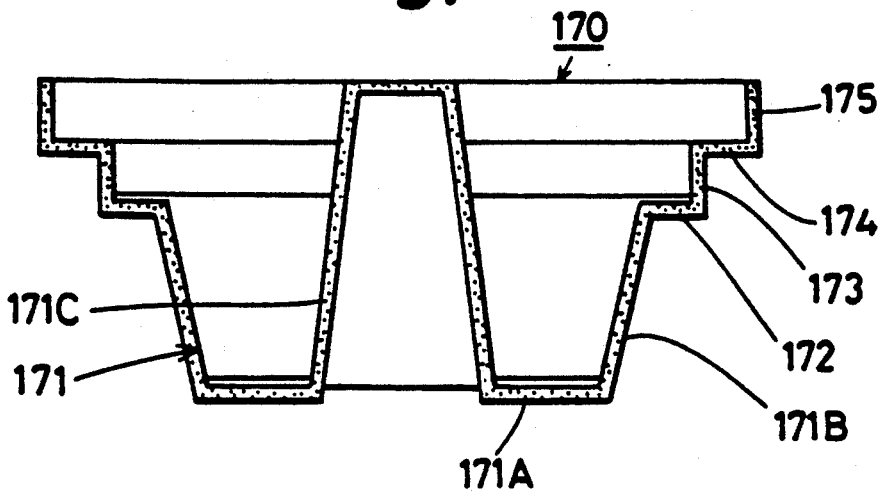
FIG. 15 is a side sectional view of the seventh embodiment of the present invention.

FIG. 15 relates to the seventh embodiment of the present invention. In this embodiment, a masking member(170) consists of an inserting part(171) having a vessel form consisting of a circular bottom(171A) from which a grip (171C) is risen and a perpendicular wall(171B) which extends upwards from the circumference of said bottom(171A), a lower flange(172) which is extended from the upper edge of said perpendicular wall(171B), a lower perpendicular wall(173) which extends upwards from the circumference of said lower flange(172), an upper flange(174) which is extended from the upper edge of said perpendicular wall(173), and an upper perpendicular wall (175) which extends upwards from the circumference of said upper flange(174). Plural ribs are respectively formed on said bottom(171A) of said inserting part (171) and said lower flange (172) to reinforce themselves. Said inserting part(171) has a taper form decreasing in diameter from the base of said inserting part (171) to the top of said inserting part(171).

Said masking member(170) may be manufactured by the vacuum forming of a thermoplastic foam sheet, the expansion molding of a thermoplastic expandable beads and the like, and when said masking member(170) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20.

Said masking member(170) of this embodiment is easily handled by holding said grip(171C) when said masking member(170) is inserted into the hole of the article or removed from the hole as same as the third, the fourth and the sixth embodiments and the film of the surface treatment may be more completely cut by said upper perpendicular wall(175) with said lower flange(172), said lower perpendicular wall(173) and said upper flange(174) than in the case of the sixth embodiment of the present invention so that said masking member(170) is more easily removed from the hole without the obstruction of the film.

Figure 16:
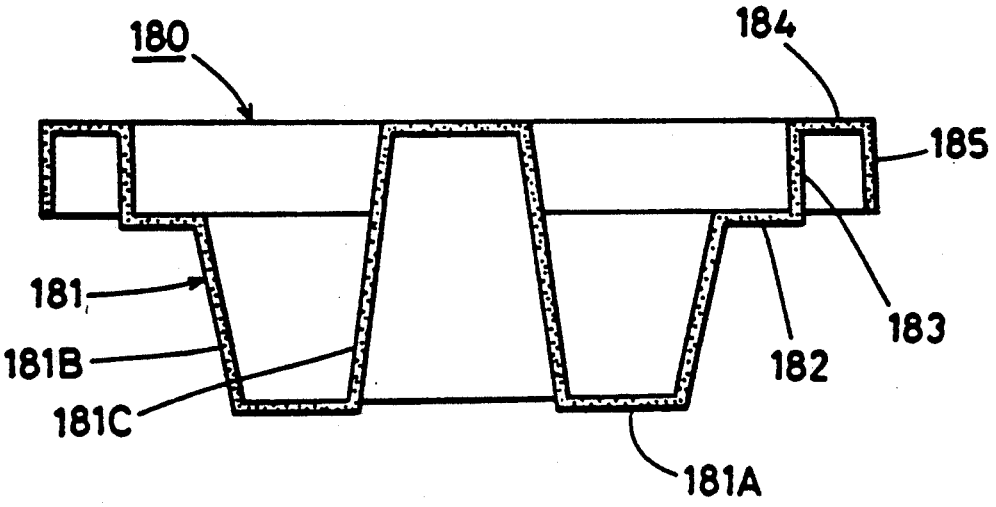
FIG. 16 is a side sectional view of the eighth embodiment of the present invention.

FIG. 16 relates to the eighth embodiment of the present invention. In this embodiment, a masking member(180) consists of an inserting part(181) having a vessel form consisting of a circular bottom(181A) from which a grip (181C) is risen and a perpendicular wall(181B) which extends upwards from the circumference of said bottom(181A), a lower flange(182) which is extended from the upper edge of said perpendicular wall(181B), an inner perpendicular wall (183) which extends upwards from the circumference of said lower flange(182), an upper flange(184) which is extended from the upper edge of said perpendicular wall(184), and an outer perpendicular wall (185) which extends downwards from the circumference of said upper flange(184). Plural ribs are respectively formed on said bottom(181A) of said inserting part(181) and said lower flange(182) to reinforce themselves. Said inserting part(181) has a taper form decreasing in diameter from the base of said inserting part(181) to the top of said inserting part (181).

Said masking member(180) may be manufactured by the vacuum forming of a thermoplastic foam sheet, the expansion molding of a thermoplastic expandable beads and the like, and when said masking member(180) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20.

Said masking member(180) of this embodiment is easily handled by holding said grip(181C) when said masking member (180) is inserted into the hole of the article or removed from the hole as same as the third, the fourth, the sixth and the seventh embodiments and the film of the surface treatment may be more completely cut by said upper flange (184) and said outer perpendicular wall(185) with said lower flange(182) and said inner perpendicular wall(183) than in the case of the sixth embodiment of the present invention so that said masking member(180) is more easily removed from the hole without the obstruction of the film.

Figure 17:
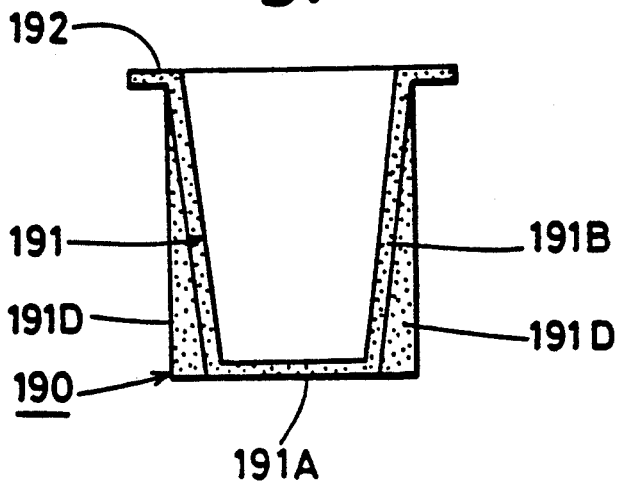
FIG. 17 is a side sectional view of the ninth embodiment of the present invention.

FIG. 17 relates to the ninth embodiment of the present invention. In this embodiment a masking member(190) consists of an inserting part(191) having a vessel form consisting of a circular bottom(191A) and a perpendicular wall(191B) which extends upwards from the circumference of said bottom(191A) and on which plural perpendicular ribs (191D) are formed, and a flange(192) which is extended from the upper edge of said wall (191B). Said inserting part (191) has a taper form decreasing in diameter from the base of said inserting part(191) to the top of said inserting part (191).

Said masking member(190) may be manufactured by the vacuum forming of a thermoplastic foam sheet, the expansion molding of a thermoplastic expandable beads and the like, and when said masking member(190) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20.

In this embodiment, said perpendicular ribs(191D) reinforce said perpendicular wall(191B) to prevent crushing of said inserting part(191) of said masking member(190) when said masking member(190) is inserted into the hole of the article and said masking member(190) is firmly held in the hole since said perpendicular ribs(191D) of said masking member(190) tightly contact to the inner wall of said hole.

Figure 18:
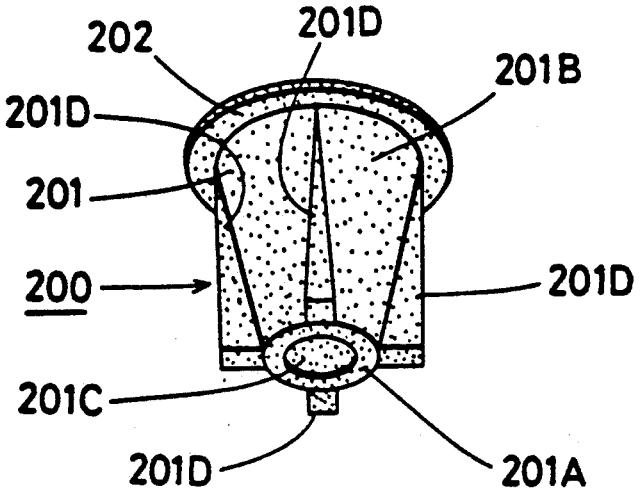
FIG. 18 is a perspective view of the tenth embodiment of the present invention.
Figure 19:
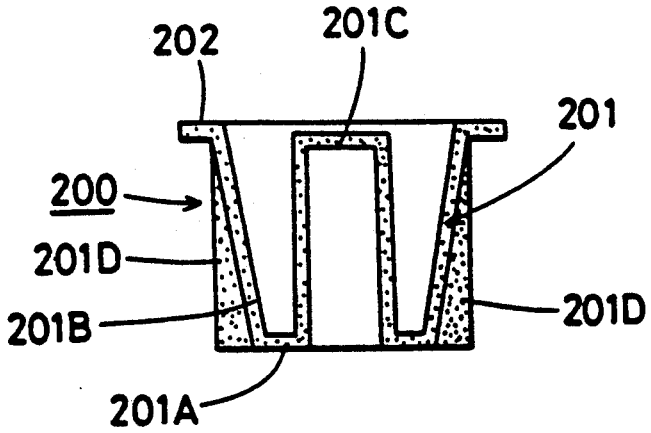
FIG. 19 is a side sectional view of the tenth embodiment of the present invention.

FIG. 18 and FIG. 19 relate to the tenth embodiment of present invention. In this embodiment, a masking member (200) consists of an inserting part(201) having a vessel form consisting of a circular bottom(201A) from which a grip(201C) is risen and a perpendicular wall(201B) which extends upwards from the circumference of said bottom(201A) and on which plural perpendicular ribs(201D) are formed, and a flange(202) which is extended from the upper edge of said wall(201B). Said inserting part(201) has a taper form decreasing in diameter from the base of said inserting part (201) to the top of said inserting part(201).

Said masking member(200) may be manufactured by the vacuum forming of a thermoplastic foam sheet, the expansion molding of a thermoplastic expandable beads and the like, and when said masking member(200) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20.

In this embodiment, said perpendicular ribs(201D) reinforce said perpendicular wall(201B) to prevent crushing of said inserting part(201) of said masking member(200) when said masking member(200) is inserted into the hole of the article and said masking member(200) is firmly held in the hole since said perpendicular ribs(201D) of said masking member (200) tightly contact to the inner wall of said hole. Further, said masking member(200) of this embodiment is easily handled by holding said grip(201C) when said masking member(200) is inserted into the hole.

Figure 20:
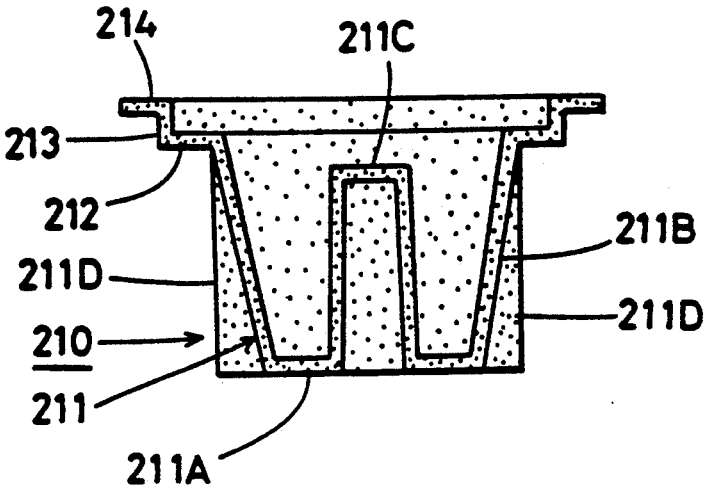
FIG. 20 is a side sectional view of the eleventh embodiment of the present invention.

FIG. 20 relates to the eleventh embodiment of the present invention. In this embodiment, a masking member(210) consists of an inserting part(211) having a vessel form consisting of a circular bottom(211A) from which a grip (211C) is risen and a perpendicular wall(211B) which extends upwards from the circumference of said bottom(211A) and on which plural perpendicular ribs(211D) are formed, a lower flange(212) which is extended from the upper edge of said wall(211B), a perpendicular wall(213) which extends upwards from the circumference of said flange(212), and an upper flange(214) which is extended from the upper edge of said perpendicular wall(213). Said inserting part(211) has a taper form decreasing in diameter from the base of said inserting part(211) to the top of said inserting part(211).

Said masking member(210) may be manufactured by the vacuum forming of a thermoplastic foam sheet, the expansion molding of a thermoplastic expandable beads and the like, and when said masking member(210) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20.

In this embodiment, said perpendicular ribs(211D) reinforce said perpendicular wall(211B) to prevent crushing of said inserting part(211) of said masking member(210) when said masking member(210) is inserted into the hole of the article and said masking member(210) is firmly held in the hole since said perpendicular ribs(211D) of said masking member(210) tightly contact to the inner wall of said hole. Further, said masking member(210) of this embodiment is easily handled by holding said grip(211C) when said masking member(210) is inserted into the hole as same as the eleventh embodiment and the film of the surface treatment may be more completely cut by said upper flange(214) with said lower flange(212) and said perpendicular wall(213) than in the case of the ninth and the tenth embodiments of the present invention so that said masking member(210) is more easily removed from the hole without the obstruction of the film.

Figure 21:
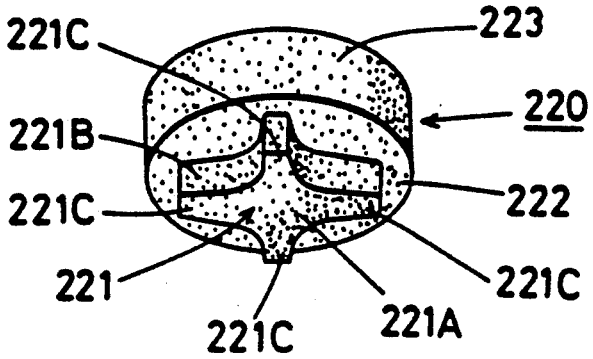
FIG. 21 is a perspective view of the twelfth embodiment of the present invention.

FIG. 21 relates to the twelfth embodiment of the present invention. In this embodiment, a masking member(220) consists of an inserting part(221) having vessel form consisting of a cross-shaped bottom(221A) and a perpendicular wall(221B) which extends upwards from the perimeter of said bottom(221A), a flange(222) which is extended from the upper edge of said wall(221B), and a perpendicular wall(223) which extends upwards from the circumference of said flange(222).

Said masking member(220) may be manufactured by the vacuum forming of a thermoplastic foam sheet, the expansion molding of a thermoplastic expandable beads and the like, and when said masking member(220) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20.

In this embodiment, said inserting part(221) is reinforced by said cross-shaped bottom(221A) to prevent crushing of said inserting part(221) of said masking member when said masking member(220) is inserted into the hole of the article, and further said masking member(220) is supported in the inner wall of said hole by only partially contacts at the tips(221C) of said inserting part(221) so that removing of said masking member(220) from the hole may be very easy.

Figure 22:
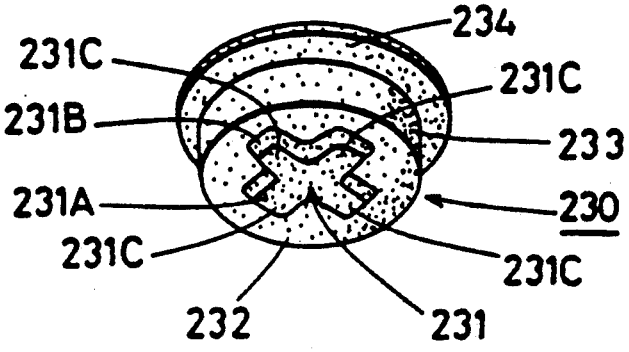
FIG. 22 is a perspective view of the thirteenth embodiment of the present invention.

FIG. 22 relates to the thirteenth embodiment of the present invention. In this embodiment, a masking member (230) consists of an inserting part(231) having vessel form consisting of a cross-shaped bottom(231A) and a perpendicular wall(231B) which extends upwards from the perimeter of said bottom(231A), a lower flange(232) which is extended from the upper edge of said wall(231B), a perpendicular wall (233) which extends upwards from the circumference of said lower flange(232), and an upper flange(234) which is extended from the upper edge of said wall(233).

Said masking member(230) may be manufactured by the vacuum forming of a thermoplastic foam sheet, the expansion molding of a thermoplastic expandable beads and the like, and when said masking member(230) is manufactured by the vacuum forming of a thermoplastic foam sheet, it is desirable that the thickness of said thermoplastic foam sheet is in the range of 0.5 to 5 mm and the expansion ratio of said thermoplastic is in the range of 2 to 20.

In this embodiment, said inserting part(231) is reinforced by said cross-shaped bottom(231A) to prevent crushing of said inserting part(231) of said masking member when said masking member(230) is inserted into the hole of the article, and further said masking member(230) is supported in the inner wall of said hole by only partially contacts at the tips(231C) of said inserting! part(231) so that removing of said masking member(230) from the hole may be very easy. The film of the surface treatment may be more completely cut by said upper flange(234) with said lower flange(232) and said perpendicular wall(233) than in the case of the twelfth embodiment of the present invention.

We claim:

1. A method for the surface treatment of an article wherein said article has an opening so as to protect the opening of said article while said article is undergoing surface treatment which comprises inserting a plug-type masking member into the opening of said article, said plug-type masking member consisting of a plug-form inserting part made up of a circular bottom and a truncated conically shaped side wall portion wherein the maximum diameter of said plug-form inserting part of said masking member is larger than the opening of said article and wherein the minimum diameter of said plug-form inserting part of said masking member is smaller than the opening, the truncated conically shaped wall portions of said plug-form inserting part extending upwardly and outwardly from the perimeter of said bottom provided with an outwardly extending flange formed around the outside at about the upper end of said wall portion of said plug-form inserting part of said masking member, said masking member being vacuum formed thermoplastic foam, effecting surface treatment of said article with said masking member inserted in said opening and removing said masking member from the opening of said article upon completion of said surface treatment, thereby leaving the opening of said article substantially unaffected by said surface treatment and protected therefrom.

* * * * *